United States Patent [19]

Monheim et al.

[11] Patent Number: 4,702,303

[45] Date of Patent: Oct. 27, 1987

[54] WIDTH ADJUSTMENT OF MOLDS FOR CONTINUOUSLY CASTING SLAB INGOTS

[75] Inventors: Peter Monheim, Dorsten; Gerhard Stadtfeld, Kamp-Lintfort, both of Fed. Rep. of Germany

[73] Assignee: Mannesmann AG, Duesseldorf, Fed. Rep. of Germany

[21] Appl. No.: 820,407

[22] Filed: Jan. 17, 1986

[30] Foreign Application Priority Data

Jan. 19, 1985 [DE] Fed. Rep. of Germany ..... 3501716

[51] Int. Cl.[4] ..... B22D 11/04; B22D 11/16

[52] U.S. Cl. ..... 164/491; 164/436

[58] Field of Search ..... 164/491, 436

[56] References Cited

U.S. PATENT DOCUMENTS 4,173,251 11/1979 Scheinecker ..... 164/436

4,356,862 11/1982 Gloor ..... 164/436 X 4,465,122 8/1984 Ohya ..... 164/491

FOREIGN PATENT DOCUMENTS 2098114A 11/1982 United Kingdom ..... 164/491

*Primary Examiner*—Nicholas P. Godici

*Assistant Examiner*—J. Reed Batten, Jr.

*Attorney, Agent, or Firm*—Ralf H. Siegemund

[57] ABSTRACT

A mold for continuous casting is changed for changing the dimensions of the casting, by, selecting a casting speed during a change of the mold dimensions which is not lower than the one prior to the change; one or both small mold walls are tilted each about an axis below the low end of the respective wall, the mold wall is then parallel shifted, the shifting to begin before the final tilting is completed; thereafter the mold wall is tilted back about an axis coinciding with a surface level of molten material in the mold, the back tilting begins before the lateral shifting ends.

4 Claims, 5 Drawing Figures

Fig.5

| | $v_{CH}$ mm/ | mm | mm | m |
|---|---|---|---|---|
| | 20 | 17,5 | — | 2,0 |
| | 20 | 4,4 | 4,2 | 2,1 |
| | 30 | 4,4 | 4,1 | 1,6 |
| | 30 | 2,1 | 3,7 | 2,3 |

| | $v_{CH}$ mm/ | mm | mm | m |
|---|---|---|---|---|
| | 20 | — | 17,5 | 2,0 |
| | 20 | 4,2 | 4,4 | 2,1 |
| | 30 | 3,7 | 4,4 | 1,4 |
| | 30 | 1,7 | 4,4 | 1,9 |

WIDTH ADJUSTMENT OF MOLDS FOR CONTINUOUSLY CASTING SLAB INGOTS

BACKGROUND OF THE INVENTION

The present invention relates to the adjustment of one or both of the narrow sides or side plates or wall plates in a mold for continuous casting of slab ingots and particularly for the casting of steel whereby adjustment is directed towards obtaining a particular conicity of and in the mold which conicity is needed to offset shrinking of the ingot on cooling; in addition the adjustability of the small sides is to accommodate molds of different rectangular cross sections.

Adjusting the sides in a mold for continuous casting generally is a complex task. The generally known practice in this regard involves in any event a particular load on the other skin of the casting having its major portion still in the liquidus state. Thus external load is effective particularly prior to the casting leaving the mold. It was found that widening of the mold increases the danger of skin rupture of the ingot or casting. This is so if the adjustment is to be carried out during the casting procedure and of course the adjusting speed is a major factor of concern. The latter aspect means that the adjusting speed has to be as low as feasible and any increase i.e. any more or less rapid widening of the mold does not appear to be practicable with the devices and methods used thus far.

In a symposium in Duisburg, West Germany, February 1984, Dr. Guenter Flemming read a paper entiled: "Format adjustment during casting—necessity, technology and engineering", reprinted on pages 121–143, published by Verein Deutscher Eisenhuettenleute/University of Duisburg, Germany. Herein the state of the art was summarized as follows. Past practice of mold changes is characterized by a period of approximately 10 years having been devoted to power and throughput increase, basically through increase of the speed of the continuous casting as such. Presently technology is directed towards more intensive cooling of the casting inside the mold in order to increase the sequence rate. Thus, present day efforts are devoted toward developing a casting program which is independent from any subsequent rolling program and permits long sequences. In conventional technology long sequences mean larger lot sizes, and that aspect leads to larger requirements for intermediate storage of castings in preparation for hot strip rolling.

On the other hand economic conditions are such that production costs generally have to be lowered meaning that intermediate storage prior to rolling should be kept as small as possible so that at least as far as practicality is concerned the casting process on one hand and the subsequent rolling process should not require extensive buffering. In addition, however, it should be realized that intermediate storage of continuous castings and ingots corresponds to the introduction of a cooling process while on the other hand and following a complete solidification of the casting the heat content thereof should be made available for subsequent hot rolling and to as large an extent as possible, particularly from the point of view of energy management.

Reducing intermediate storage and utilizing as much as possible the heat content of a casting presupposes that the ingot as produced by the casting machine has already exactly those dimensions needed for the subsequent rolling process. Thus, aside from the requirement for throughput increase of the casting machine by operation of long sequences one has to accommodate also the width dimensions of the rolling machine. This adaptation should occur during the casting process. Therefore it is the aim of production planning for continuous casting to tie the casting to the rolling program as much as possible so that rolling can indeed follow immediately the casting. Tying these two programs together means that within a short period of time considerable width changes in the casting have to be accommodated. This in turn implies that during casting at first a change to larger width as rapidly as possible should be accommodated following a reduction in width in more or less small steps until the program has been completed. These overall requirements pose therefore directly a specific task and problem towards adjusting the format in the casting machine. The critical aspect during adjusting the width of the mold is the support of the small or narrow sides. Adjustment of the narrow mold sides requires to some extent an "opening of the mold" so as to permit movement of the small sides in parallel. Accordingly a gap will appear during the adjustment between the mold content and a barely solidified skin on one hand and the mold wall on the other hand. Such a gap is immediately effective as a heat barrier i.e. the requisite heat transfer from the casting material into the mold wall particularly of the small sides is now impeded; at least as far as heat conduction is concerned; some cooling still occurs through thermal radiation but this heat transfer is insufficient. Moreover, the particular maximum gap is retained during the entire adjustment process.

It can readily be seen that insufficient cooling during the casting process establishes immediately and directly the danger of rupture of the skin. Particularly, if during the casting the small sides are moved outwardly towards an increase in ingot width these gaps form and pose the problem of rupture as mentioned. It is also apparent that the more pronounced the danger is, the higher the adjustment speed; the skin generally will be thinner than normal when the casting leaves the bottom of the mold.

Still referring to the state of the art, for several years in many parts of the world, modified programs of mold side movement have been investigated. In accordance with known technology the small sides are adjusted in three steps for purposes of increasing the ingot width. In accordance with the first step particularly in the beginning, the particular mold wall or walls are tilted about points in the lower part of the mold. In the second step a parallel displacement of the small side obtains i.e. the small side retains its orientation and the speed is matched to the speed of the casting. However, the paper referred to above does not explicitly explain the orders of magnitude involved in this matching procedure. In accordance with the third step, being so to speak a terminating step of the adjustment, a small mold side is tilted back in such a manner that in the upper portion the ingot, still being inside the mold, is slightly upset while in the lower portion of the mold a small gap between the mold wall and ingot or casting surface is deemed to be permissible. As far as this third step is concerned, it is not clear however how this slight upsetting of the ingot is supposed to occur in the upper part of the mold while in the lower part a gap is supposed to appear.

Finally the state of the art tends to optimize tilting in dependence upon casting speed and mold wall adjusting speed. In accordance with the above paper, nothing was said how optimized tilting in dependence upon these parameters is supposed to occur. It can thus be seen that the prior art can be summarized as follows.

Further increase of the mold wall adjusting speed does not seem to be justified since it seems to inevitably entail further loading and load exertion upon the skin of the casting which is simply not justified because of the rupture danger. Increasing the casting speed may reduce deformation as well as the gap but also means a larger transition between the two different dimensions of the casting which is the so called adjustment taper. Presently, adjusting speeds of about 15 mm/minute per side during increase and 20 mm/minute per side during reduction of the width of casting for a casting speed between 1.0 and 1.2 m/minute and a mold length of 700 mm are deemed to be the optimal values.

In order to drastically improve the state of the art, the mold length is a parameter which is of considerable importance. Standardized length for casting of slab ingots are for example 704 mm and 904 mm whereby it has to be noted that for such long molds usually one, two or several rollers are fastened to the lower ends of the small mold wall sides, possibly also on the wide sides and the active mold length has to consider the presence of these rollers. The so called short molds being used have a length of about 500 mm and they too include one, two or several rollers. Again the foot rollers have to be considered in considering the active mold length.

The equipment for adjusting one or several sides in a mold requires an optimized sequence of motions of machine parts and in accordance with the state of the art in order to obtain a high degree of flexibility as a whole. This means that the construction of the equipment for mold wall adjustment must permit independent motion for width adjustment as well as for adjusting the conicity. Construction of molds using copper plates for wide and narrow sides are generally known. The devices for adjusting one or two small side plates includes generally a pair of axially movable nuts being connected (linked) to the small mold sides. Usually driven threaded spindles are screwed into these nuts. The spindles of the pair can be driven at different speeds in order to obtain mold wall tilting. Both spindles will be driven from one motor via appropriate transmission gearing. Parallel shifting is also possible whereby however a change in conicity is not possible. On the other hand different pitches in the upper and lower spindles or different transmission ratios permit linear, width-dependent conicity changes. This kind of construction can be modified through using a coupling between the two spindles such as an electromagnetic clutch whereby in addition to the displacement of the narrow mold wall sides these clutches can be selectively deactivated in order to obtain a change in conicity. This means that optimized pivoting of the small mold wall side or sides about an upper as well as a lower part of the mold is actually not possible.

Another aspect of the state of the art is to be seen in the complete separation of the two spindles by providing separate drives for each of them. This kind of a design does indeed permit free adjustment for the mold wall sides for shifting and tilting. However, this independence in terms of structure requires a very high reliability with regard to electrically synchronising upper and lower drives because otherwise conicity may change in an uncontrollable fashion, at too high a rate; and even if brief severe ruptures may entail.

Thus summarizing this more accurate state of the art the previous conceptions in this regard can be described as follows. A speed controllable electromotor runs a gear for both adjusting spindles. Slight differences in speed reduction as applied to the different spindles establish the desired conicity over the entire range for the mold and mold width program. For each of the step widths such an adjustment is negligible small and does not have to be considered further. Moreover theoretically a very accurate parallel shifting of the small sides is possible.

SUMMARY OF THE INVENTION

It is an object of the present invention to improve the adjustment of molds and mold walls for continuous casting in order to overcome the deficiences outlined above and to increase the speed of mold wall adjusting. It is a feature of the present invention to retain the concept of the three steps outlined above, namely forward tilting, parallel adjustment and return tilting, for decreasing the taper length in between two different casting widths, under consideration of reducing any gap between mold wall and casting avoiding actually as much as possible any gap formation in view of the entailing rupture danger, and to provide an adjustment motion such that tearing of the lubricant between casting and mold wall is avoided.

Therefore, from a production point of view, it is an object of the present invention to reduce the gap between mold wall inside and the casting metal as well as to reduce the degree of deformation that occurs during adjustment of the mold wall towards a reduction in long dimensions of a slab ingot being cast. Therefore it is a feature of the present invention to provide for adjustment of the mold walls under consideration of the active length of the mold.

In accordance with the preferred embodiment of the present invention the objects are attained, particularly for increasing the width of the ingot, in that for a uniform casting speed or even at an increase in the casting speed over the normal speed, the active mold length is pivoted about a hypothetical axis of rotation below the respective small side of the plate which during adjustment of the final conicity pivoting occurs about an axis in the surface level of the molten material in the mold. This mode of operation offers the following advantages.

On the basis of actually conducted tests it was found that upon proceeding as stated the gap width will decrease rather than increase with increasing casting speed. Such a result is quite surprising and contradicts prior art assumptions. Previously it was customary to decrease the casting speed during adjusting of the mold. For example the casting speed was decreased by 50% from 1.2 m/minute down to 0.6 m/minute. Applicants have discovered that such an approach is not only not required but actually outright wrong. Maintaining the casting speed as before or even increasing the casting speed permits the adjustment of the mold wall to be carried out much more successfully than in the past whereby in fact smaller tapered portions than before are produced. The lubricant layer will not rupture as was usually observed in prior art practice. Also, the degree of deformation of the casting and its newly form solidified skin is quite limited. A particular advantage of the invention is to be seen in that the small side plates with foot rollers will not wear the casting, at least to a lesser degree than before.

The gap between the inside of the small mold side plates and the metal in the mold cavity will be maintained substantially uniform throughout the entire adjusting procedure. This is so because in accordance with further features of the invention an in between period of tilting about a hypothetical axis below the small side plate will be carried out at an increased tilting speed. The adjusting is even more favorable if in the beginning of increasing the width of the casting cavity the small side plates will be tilted outwardly with a horizontal parallel displacement being superimposed. Also, prior to completing the width increase and still during the regular horizontal, parallel shifting of the respective plate one begins already to tilt back towards the new conicity. In other words these steps outlined above in terms of first, second and third steps are made to overlap, and this overlapping particularly leads to small tapered casting portions without unduly wearing on the casting strand and without undue deformation and without interfering at least not to a substantial degree with a lubricant layer.

It is furthermore of advantage to determine the amount of tilting in outward direction on the basis of the casting speed and under consideration of the overlapping and continued adjusting parallel speeds and under further consideration of the actually present active mold length.

As far as reducing the ingot and casting width is concerned, it is proposed in accordance with the preferred embodiment that during such a reduction again the casting speed is either maintained or even increased while the respective small mold sides are at first tilted back in accordance under consideration of the entire active mold length, then (but overlappingly) parallely adjusted, and before the smaller width of the mold cavity has obtained the newly required conicity is established through back tilting of that mold wall side. The first tilting is again carried out about a hypothetical axis of rotation situated below the small side plate, while the restoring of a particular conicity occurs through tilting about an axis which is again situated in the surface level of the bath of molten metal in the mold.

Equipment for carrying out the inventive method presupposes a mold for continuous casting having small side plates which are connected pivotally universally linked to nuts axially receiving driven spindles; the two spindles for any wall side are being driven differently, and each spindle is separately geared to separate motors each of them being electrically controllable on an individual basis. In order to practice the inventive method in particular it is required that each small mold side plate is pivotable about a lowest point of the active mold length establishing the disposition of the lower hypothetical axis of turning and by providing pivotability about an axis that is located in the expected surface level of molten material. The tilting in this fashion is not provided through a shaft having these axes, rather through selection of adjusting speed of the vertically spaced linkage points such that the speed in the aforementioned lowest point of the active mold wall length or in the surface level of the casting material is in fact 0. The connecting points of the two nuts referred to above are divided in lever length with reference to a common plane of the foot roller tangent point in the inside surface of the mold wall plate. The division in lever length takes into consideration the velocity vectors at the respective linkage points of the nuts during increasing or decreasing the casting width and it takes also the maximum adjusting speed into consideration. Thus, the point of linking the two nuts to the mold wall side plate are not characterized by uniform distances as was common practice and it is left open how the two drive motors are controlled, electronically or otherwise and what the control parameters actually are. Rather it is merely required that once a maximum adjusting speed has been predetermined the lever length corresponding to the point of attack related to the respective zero point of such turning motion in each instance is brought into a predetermined transmission ratio. The inventive equipment fulfills this requirement.

BRIEF DESCRIPTION OF THE DRAWINGS

While the specification concludes with claims particulalry pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 5 shows tables for actual values corresponding to opening and closing of the mold within the general context of this invention.

DETAILED DESCRIPTION OF PREFERRED EMBODIMENTS

Figure 1:
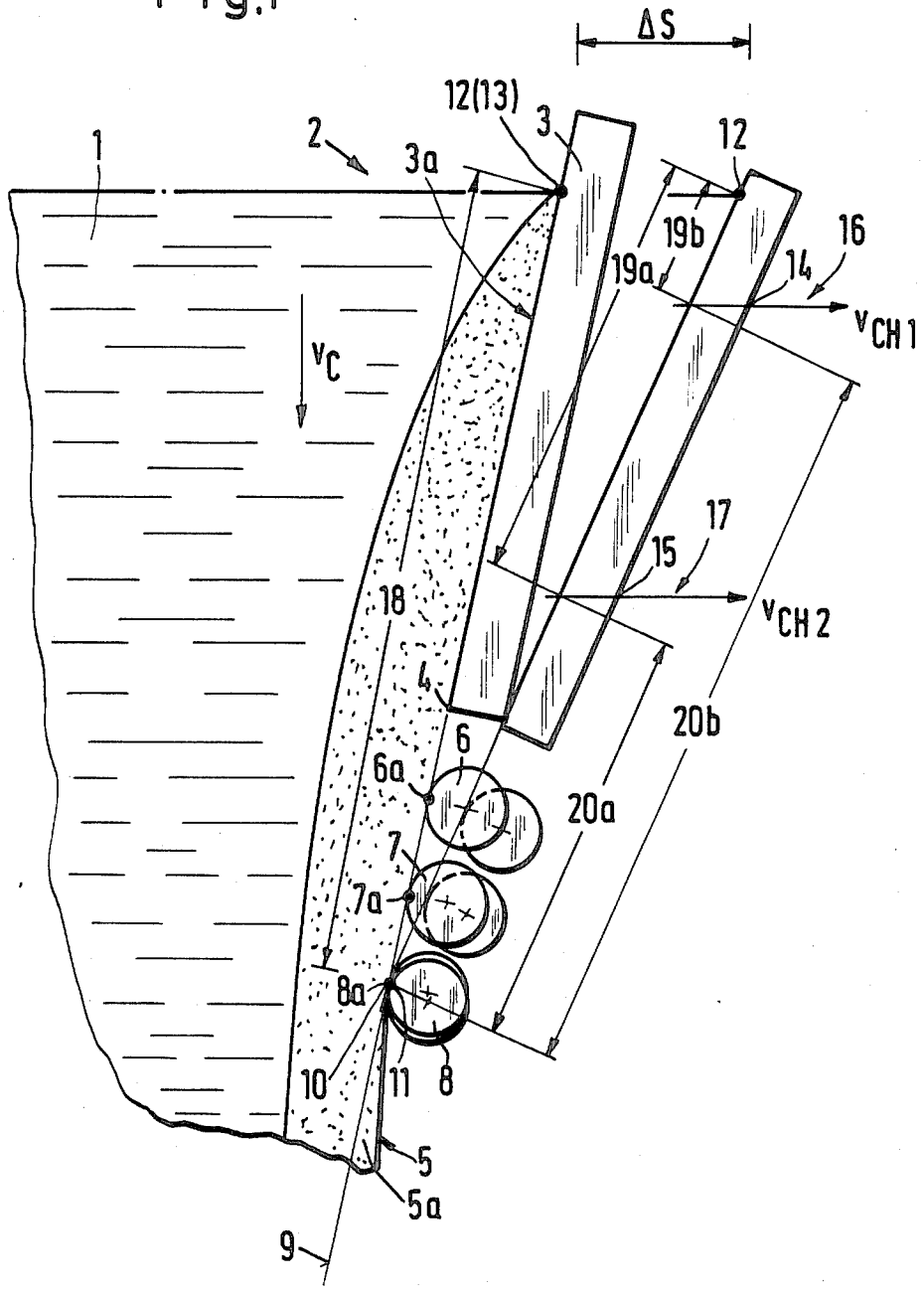
FIG. 1 illustrates a small side plate of a mold for continuous casting with foot or bottom rollers and showing the plate in a side elevation for two different positions, namely an initial position and a final conicity position.

Reference is made to FIG. 1 illustrating a bath of molten steel 1 which generally flows in the direction of casting indicated by the speed vector Vc. The motion occurs inside the casting mold 2, the mold being represented in this instance just by a small side plate 3. "Small" side plate means that the dimensions of plate 3 in the perpendicular direction relative to the plane of the drawing are smaller than the dimensions of an orthogonally oriented plate parallel to the plane of the drawing. As shown in FIG. 1 the small side plate 3 is obliquely disposed which is defined by an angle to the vertical, and that angle corresponds to the calculated shrinkage of the casting 5 while the material flows in down direction towards the exit 4.

Reference numeral 5*a* refers to the outer skin of the casting and it is in fact the skin which undergoes some shrinkage. Foot or bottom rollers 6, 7 and 8 are fastened to the plate 3 where indicated. These rollers oscillate together with the mold 2 as a whole. Such an oscillation is customary for purposes of ensuring that the casting will not stick to the mold.

The small side plate 3 has an inside surface 3*a* and reference numerals 6*a*,7*a* and 8*a* refer to tangent points respectively of the foot rollers 6,7, and 8. These tangent points engage the casting skin on the outside. These points establish a single plane 9. Taking all these aspects together it is apparent that the lowest tangent point 8*a* is equivalent to a point 10 defining the lowest end point of the active mold wall length. The total length being defined by the distance 18. If only two or just one of these foot rollers are provided then this lowest point 10 defining the lower dimension of the active mold wall length is shifted up accordingly.

Figure 2:
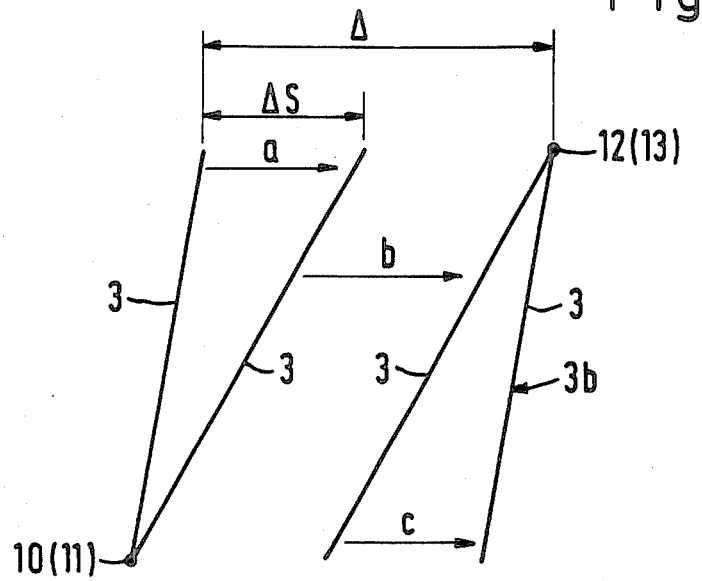
FIG. 2 illustrates the adjusting dynamics for increasing the casting width illustrating the individual steps.
Figure 3:
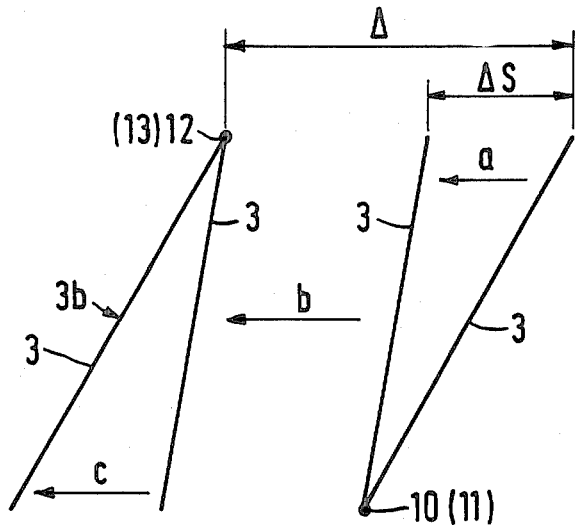
FIG. 3 is analogously a diagram showing the dynamics for the reduction in casting width.

In accordance with the present invention the point 10 has further significance for defining the hypothetical turning or pivoting axis 11 extending transversely to the plane of the drawing and constituting an axis of rotation for the mold wall plate 3 during changing of the width of the casting. Referring specifically to FIG. 2, upon increasing the casting width a pivot motion a is produced and that motion occurs about the axis 11. In addition an overlapping parallel shifting b obtains. Analogously axis 11 is effective during reduction of the casting width (FIG. 3). Again the pivot motion as indicated by a serves and in its end phase may overlap a parallel adjustment identified also here by reference character b.

FIG. 1 shows also the intersection of the casting surface level with the mold wall 3. The point or line of intersection is identified by reference numeral 12 and establishes the disposition of a second hypothetical axis of rotation likewise extending transversely to the plane of the drawing of FIG. 1. This axis of rotation or tilting axis 13 is effective during increasing the width of the casting as shown in FIG. 2. The pivot motion being identified by reference character c primarily for adjusting the final conicity 3*b*. Analogously the axis 13 is also effective during reduction of the casting width as shown in FIG. 3 also as the pivot motion in order to obtain the final conicity 3*b*. The motions b and c may also overlap.

As shown in FIG. 1 the points 14 and 15 identifying points in which adjusting nuts 16 and 17 are linked to the mold wall 3 and can be projected into the plane 9. The active mold length 18, the turning axes 11 and 13 together with lever length 19*a* and 19*b* as wall as 20*a* and 20*b* are parameters for detemining the local speed of adjustment $V_{CH1}$ and $V_{CH2}$. These parameters are in fact modifiers for a rather high or maximum adjusting speed which is immediately dependent on a rather high casting speed. The ultimate factor that determines casting speed are the metallurgic cooling conditions obtained by the operation.

Having given a casting speed dependent, overall maximum (possible) adjusting speed for the mold wall the aforementioned parameters are then used to determine the local adjusting speed at these linking points 14 and 15. The speed differentials here introduce the requisite wall tilting. The various speed values are obtained through control of the motors not shown, driving spindles, which are also not shown, these spindles are threadidly received by the nuts 16 and 17. The controls of these two motors is carried out electronically in order to obtain the requisite resolution of control operation.

The events as per FIGS. 2 and 3 are carried out for example at an unmodified casting speed. However, as was mentioned above it is conceivable that the casting speed is actually increased during the adjusting operation. It is within the purview of this invention that a reduction in casting speed is no longer necessary, and it was elaborated above that such speed reduction is actually undesirable. For increasing the width of the casting as per FIG. 2 one may in fact even increase the speed for the pivot motions a and c. Another variant as far as the adjusting dynamics is concerned is to be seen in that the pivot motion a and the parallel motion b and/or the parallel motion b and the pivot motion c are carried out in overlapping relationship i.e. they are not necessarily fully sequential but coincide to some extent. The entire adjusting path (Δ width) may be 25 mm or any other suitable value depending on the conditions and circumstances of casting.

For decreasing the casting width one has to consider the fact that a certain additional load will act on the reduced casting strand; the load acting particularly on the shell 5*a* during the corresponding pivot motion a. Therefore a certain deformation work is exerted upon the casting. The casting 5 can indeed take that deformation without the danger of crack formation if the inventive procedure is observed. Here particularly the disposition of the axes of turning or rotation, 11 and 13, permit a limiting of the deformation of the material which is prone to develop cracks.

Figure 4:
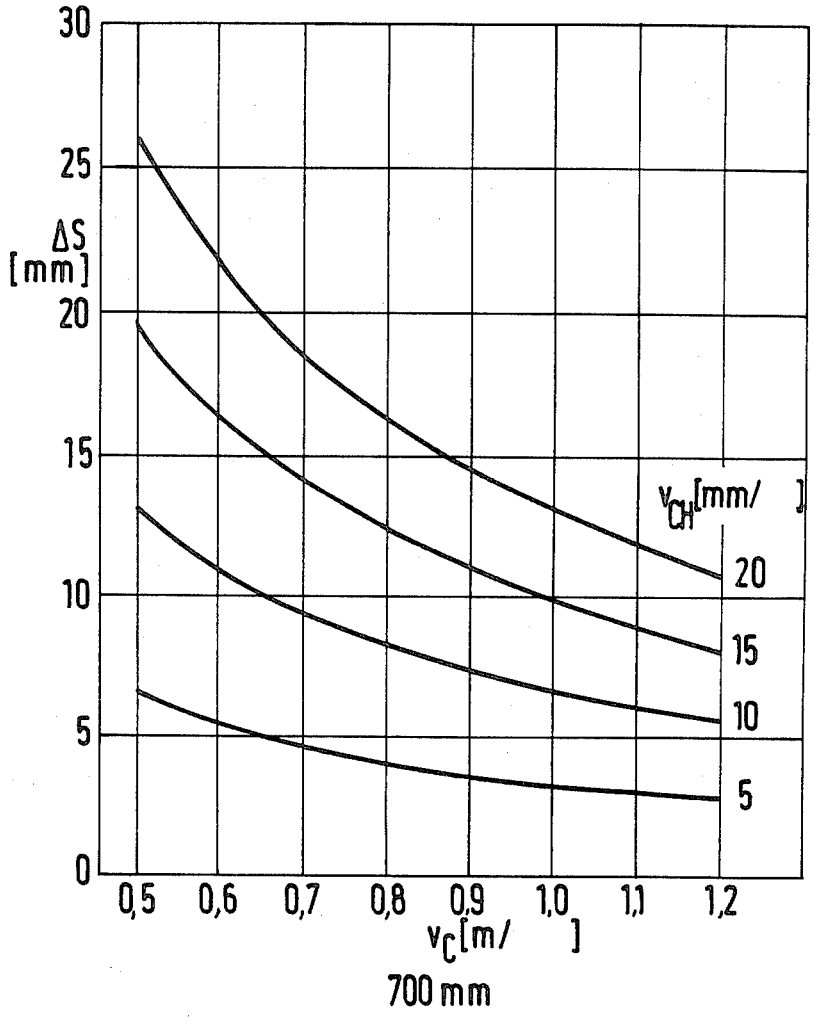
FIG. 4 illustrates a diagram in which gap width, casting speed and mold wall adjusting speed are interrelated.

The limits to be observed within the context of practicing the invention are empirically obtained. FIG. 4 illustrates basic aspects for the determination of these limits. It is assumed that an active mold length of 700 mm is present. For adjusting speeds of 5,10,15 and 20 mm/minute one can read from the graph the respective gap width identified as Δs. For a casting speed of 1.2 m/minute which is a customary value, the adjusting speed $V_{CH}$ may be 10 mm/minute and now one has to expect a gap of about 5.5 mm. The casting 5 will return quickly to the small side plate 3 on account of the inventive features so that the danger of rupture of skin 5*a* is indeed very small. Other practical values are also derivable from FIG. 5. An active mold length of 1400 mm is assumed. It will be noted that this active mold length (18) is measured from the surface level of the molten material down to the tangent point of the lowest foot roller. In this example a casting speed of 1.6 m/minute is assumed and the width change (Δs) amounts to 25 mm. From the table one can read that for a maximum adjusting speed of 30 mm/minute only a gap of about 2.1 mm is to be expected and a maximum deformation of 3.7 mm obtains so that the length of the tapered zone in the casting is only above 2.3 m. This length can actually be further reduced to about 1.6 mm if one is willing to accept a slightly increased gap width of about 4.4 mm and a slightly larger deformation of about 4.1 mm.

The table of FIG. 5 shows also that in the case of narrowing the mold for comparable adjusting speeds in mm/minute one obtains comparably small gap widths of 3.7 and 1.7 mm respectively, and a correspondingly lower deformation for a still smaller tapered length of 1.4 and 1.9 m. Particularly in the case of a higher adjusting speed $V_{CH}$ it is a surprising result that the deformation is comparable for widening and narrowing the mold.

The invention is not limited to the embodiments described above but all changes and modifications thereof, not constituting departures from the spirit and scope of the invention, are intended to be included.

We claim:

1. Method of operating a mold for continuous casting for changing the dimensions of a casting there being at least one small side plate provided for adjustment, said plate having foot rollers underneath, in contact with the casting emerging from the mold, said adjustment including shifting and tilting of the plate comprising the steps of:

selecting a casting speed during a change of mold dimensions which speed is not lower than the one prior to the change;

first, tilting the plate including the foot rollers thereof about an axis below a low end of the plate at a level of the lowest one of the foot rollers and in a beginning of an adjusting phase;

laterally shifting said plate, said shifting to begin after the beginning of said tilting; and second, back or return tilting of said plate about an axis, above said first mentioned axis and coinciding with a surface level of molten material in said mold, the return tilting beginning after the lateral shifting has begun.

2. Method as in claim 1 wherein said tilting about the axis below the low end of the plate includes a tilting phase subsequent to beginning and prior to ending of such tilting being carried at a relatively higher speed than before and after.

3. Method as in claim 1 wherein said lateral shifting step commences prior to completion of said first tilting step and terminates after commencement of the second tilting step.

4. Method as in claim 1 wherein there are two adjustment drives linked to said plate at different levels, said pivot axes being established through differences in speed of adjustment of the mold as imparted by the drives upon said plate.

* * * * *